US006887034B2

(12) United States Patent
Mesiter et al.

(10) Patent No.: US 6,887,034 B2
(45) Date of Patent: May 3, 2005

(54) CENTRIFUGAL PUMP HAVING ADJUSTABLE CLEAN-OUT ASSEMBLY

(75) Inventors: David L. Mesiter, Mansfield, OH (US); James T. Hooker, Mansfield, OH (US); Michael L. Keith, Mansfield, OH (US); Eddie D. Cottrell, Mansfield, OH (US)

(73) Assignee: The Gorman-Rupp Company, Mansfield, OH (US)

( * ) Notice: Subject to any disclaimer, the term of this patent is extended or adjusted under 35 U.S.C. 154(b) by 0 days.

(21) Appl. No.: 10/221,825

(22) PCT Filed: May 15, 2001

(86) PCT No.: PCT/US01/16186

§ 371 (c)(1),
(2), (4) Date: Sep. 16, 2002

(87) PCT Pub. No.: WO01/90583

PCT Pub. Date: Nov. 29, 2001

(65) Prior Publication Data

US 2003/0206797 A1 Nov. 6, 2003

Related U.S. Application Data

(60) Provisional application No. 60/205,384, filed on May 19, 2000.

(51) Int. Cl.[7] ..... F04D 29/42

(52) U.S. Cl. ..... 415/128; 415/174.1; 415/230; 415/205; 415/206; 415/214.1

(58) Field of Search ..... 415/128, 174.1, 415/201, 204, 205, 206, 214.1, 168.2, 170.1, 171.1, 229, 230

(56) References Cited

U.S. PATENT DOCUMENTS 1,088,515 A 2/1914 Bazin
1,735,754 A * 11/1929 Hargis ..... 415/128

(Continued)

FOREIGN PATENT DOCUMENTS

| | | |
|---|---|---|
| DE | 3513116 | 10/1986 |
| EP | 0292113 | 11/1988 |

OTHER PUBLICATIONS 1 page sheet of a prior art wear ring adjustment design by The Gorman–Rupp Company that was on sale prior to May 1999.

(Continued)

*Primary Examiner*—Ninh H. Nguyen
(74) *Attorney, Agent, or Firm*—Watts Hoffmann Co.

(57) ABSTRACT

A centrifugal pump having an adjustable clean-out assembly (60), the position of which determines the face clearance between a wear plate (72) and an impeller (20). The clean-out assembly includes an end cover (63) that threadedly mounts a plurality of adjustment assemblies. The adjustment assembly includes an adjuster (104) that defines a through bore for slidably receiving a retaining stud (66) that extends from the pump housing. Each adjuster includes an abutment surface (108) which engages a pump surface and which establishes the face clearance between the wear plate and the impeller. Each adjuster includes a hex-shaped head which is engageable by an associated locking member (120) secured to the end cover. Each locking member includes a locking collar **(120*a*)** having 18 teeth which allows the collar to engage the hex-shaped head of the adjuster in 18 different postions. By knowing the thread pitch of the adjuster thread, precise rotations of the adjuster can be used to establish a precise clearance between the wear plate and impeller. Once the adjustment is made, the locking collar is secured to the end cover which enables the clean-out assembly to be removed from the pump without disturbing the adjustment.

24 Claims, 7 Drawing Sheets

U.S. PATENT DOCUMENTS

| | | | | | |
|---|---|---|---|---|---|
| 1,891,267 | A | | 12/1932 | Milkowski | |
| 2,285,976 | A | * | 6/1942 | Huitson | 415/128 |
| 2,365,058 | A | * | 12/1944 | Crawford | 415/196 |
| 3,180,568 | A | * | 4/1965 | Oettle | 415/175 |
| 3,272,137 | A | | 9/1966 | Maitlen et al. | |
| 3,324,800 | A | * | 6/1967 | Schroeder | 415/128 |
| 3,493,026 | A | | 2/1970 | Donofrio et al. | |
| 3,778,181 | A | | 12/1973 | McFarlin | |
| 3,898,014 | A | | 8/1975 | Meister et al. | |
| 4,052,133 | A | | 10/1977 | Yeater | |
| 4,284,114 | A | | 8/1981 | Korenobu | |
| 4,527,948 | A | | 7/1985 | Addie | |
| 4,734,001 | A | | 3/1988 | Bennett | |
| 5,168,626 | A | * | 12/1992 | Dorski et al. | 29/888.021 |
| 5,921,748 | A | * | 7/1999 | Frater | 415/172.1 |
| 6,099,243 | A | * | 8/2000 | Fiore | 415/111 |
| 6,464,454 | B1 | | 10/2002 | Kotkaniemi | |
| 6,599,086 | B2 | | 7/2003 | Soja | |

OTHER PUBLICATIONS 4 page publication and drawing showing a pump design by WEMCO, publication date unknown, drawing date 1984.

1 page drawing of a prior art submersible pump by The Gorman–Rupp Company that was on sale prior to May 1999.

2 page drawing No. 46127–915of a prior art pump by The Gorman–Rupp Company dated 1990.

1 page drawing of a prior art pump by The Gorman–Rupp Company that was on sale prior to May 1999.

3 page drawing of a prior art pump by The Gorman–Rupp Company that was on sale prior to May 1999.

1 page publication entitled "The bolt stops here," Machine Design (Nov. 2000).

European Search Report.

* cited by examiner

CENTRIFUGAL PUMP HAVING ADJUSTABLE CLEAN-OUT ASSEMBLY

This application claims benefit of Provisional Application No. 60/205,384 filed May 19, 2000.

TECHNICAL FIELD

The present invention relates generally to fluid pumps and, in particular, to a centrifugal pump having apparatus for adjusting the face clearance between a wear plate and a pump impeller.

BACKGROUND ART

Centrifugal pumps are well known in the art and are used for many fluid pumping applications. For example, centrifugal pumps may be used to pump water from one water station to another. They may also be used in construction applications, i.e., to pump water from an excavation cite.

Occasionally, a pump may ingest solid material which can cause clogging of the pump or compromise its operation in other ways. Many times this clogging may necessitate the disassembly of the centrifugal pump in order to remove the material.

Clean-out assemblies allowing access to an impeller chamber have been used in internally self-priming, centrifugal pumps. Examples of pumps having this feature are known as "T-Series" pumps sold by The Gorman-Rupp Company. A self-priming pump having clean-out capability is illustrated in U.S. Pat. No. 3,898,014.

A clean-out assembly for another type of centrifugal pump is disclosed in co-pending U.S. provisional application Ser. No. 60/178,174, filed Jan. 26, 2000, which is hereby incorporated by reference.

In the types of pumps to which this invention pertains, an impeller is rotatable within an impeller chamber and is located adjacent a wear plate. Normally, the impeller is spaced a predetermined distance from the wear plate. This space or gap is normally referred to as "face clearance." Excessive face clearance usually reduces the efficiency of the pump so it is desirable to maintain a predetermined clearance that is normally set at the factory. Over time, the face clearance increases due to wear in the wear plate and/or impeller. As a consequence, periodic readjustment is necessary to reset the face clearance.

In the centrifugal pumps disclosed in the above-identified U.S. Patent and U.S. provisional application, the wear plate is mounted to the clean-out assembly. The clean out assembly is normally mounted to the front of the pump, whereas a rotating assembly including the impeller, and drive shaft for the impeller, is mounted from the opposite side of the pump housing. In the past, the face clearance between the wear plate and the impeller (which forms part of the rotating assembly) was established by shimming the rotating assembly. In particular, appropriate shims were placed between the pump housing and a flange forming part of the rotating assembly. The shims determined the face clearance and were held in position by bolts that secured the flange to the housing.

In these types of pumps, the drive shaft which extends from the rotating assembly is coupled to a drive motor. If the position of the rotating assembly changes with respect to the pump housing due to a change in shims, an adjustment would also have to be made to the coupling between the drive shaft and drive motor to accommodate the change in position. Alternately, the position of the drive motor and/or pump would require changing in order to accommodate the change in position of the rotating assembly. In the past, shimming of the rotating assembly, rather than the clean-out cover assembly, was preferred because the clean-out assembly is removed quite frequently, as compared to the rotating assembly.

DISCLOSURE OF INVENTION

The present invention provides a new and improved centrifugal pump that includes apparatus for easily adjusting and re-adjusting a face clearance between a wear plate and an impeller. In the illustrated embodiment, the centrifugal pump includes a pump housing to which a rotating assembly, including a pump impeller, is mounted. The pump impeller defines an axis of rotation. A removable clean-out assembly is mounted to the pump and supports the wear plate in axial alignment with the impeller and includes an end cover. At least one adjustment member is carried by the end cover for adjusting the face clearance between the wear plate and the impeller. The adjuster includes an adjustment member threadedly received by the end cover and which defines a bore for receiving a mounting stud that extends from the pump housing. An abutment surface is defined by the adjuster which abutably contacts a surface on the pump housing, whereby the position of the adjuster in the end cover determines the spacing between the impeller and the wear plate. A locking member for locking the adjuster with respect to the end cover is provided which inhibits rotation after the adjustment has been made.

In the illustrated embodiment, four adjustment members are carried by the end cover. It should be understood, however, that the invention contemplates other numbers of adjusters which may be less than four or more than four, depending on the application.

According to a feature of the invention, the adjuster includes a polygonal-shaped head, such as a hex-shaped head that is engageable by a collar portion of the locking member. The locking member includes head engagement structure which allows the collar portion to engage the head in any one of a plurality of positions. In the exemplary embodiment, the head portion of the adjuster is hex-shaped and the structure in the collar portion defines 18 teeth, such that the collar portion can be positioned on the head portion of the adjuster in any one of 18 positions.

By knowing the pitch of the thread machined into the adjuster, the adjuster can be incrementally rotated to produce precise axial movements. These axial movements of the adjuster produce movement in the wear plate (which is attached to the end cover) towards and away from the impeller. The teeth forming part of the collar portion can be used to accurately rotate the adjuster to produce a desired clearance between the wear plate and impeller. Once an adjustment is made, a locking bolt is used to secure the locking member in order to inhibit further rotation in the adjuster.

With the disclosed embodiment, the clearance between the wear plate and impeller can be easily set during assembly and then easily readjusted during operation to compensate for wear. In addition, with the preferred embodiment, the clean-out assembly can be removed from the pump without disturbing the adjustment.

The invention also contemplates a pump construction in which the adjustment members are used to adjust the position of the rotating assembly.

Additional features of the invention and a fuller understanding obtained by reading the following detailed description made in connection with the accompanying drawings.

BEST MODE FOR CARRYING OUT THE INVENTION

Figure 1:
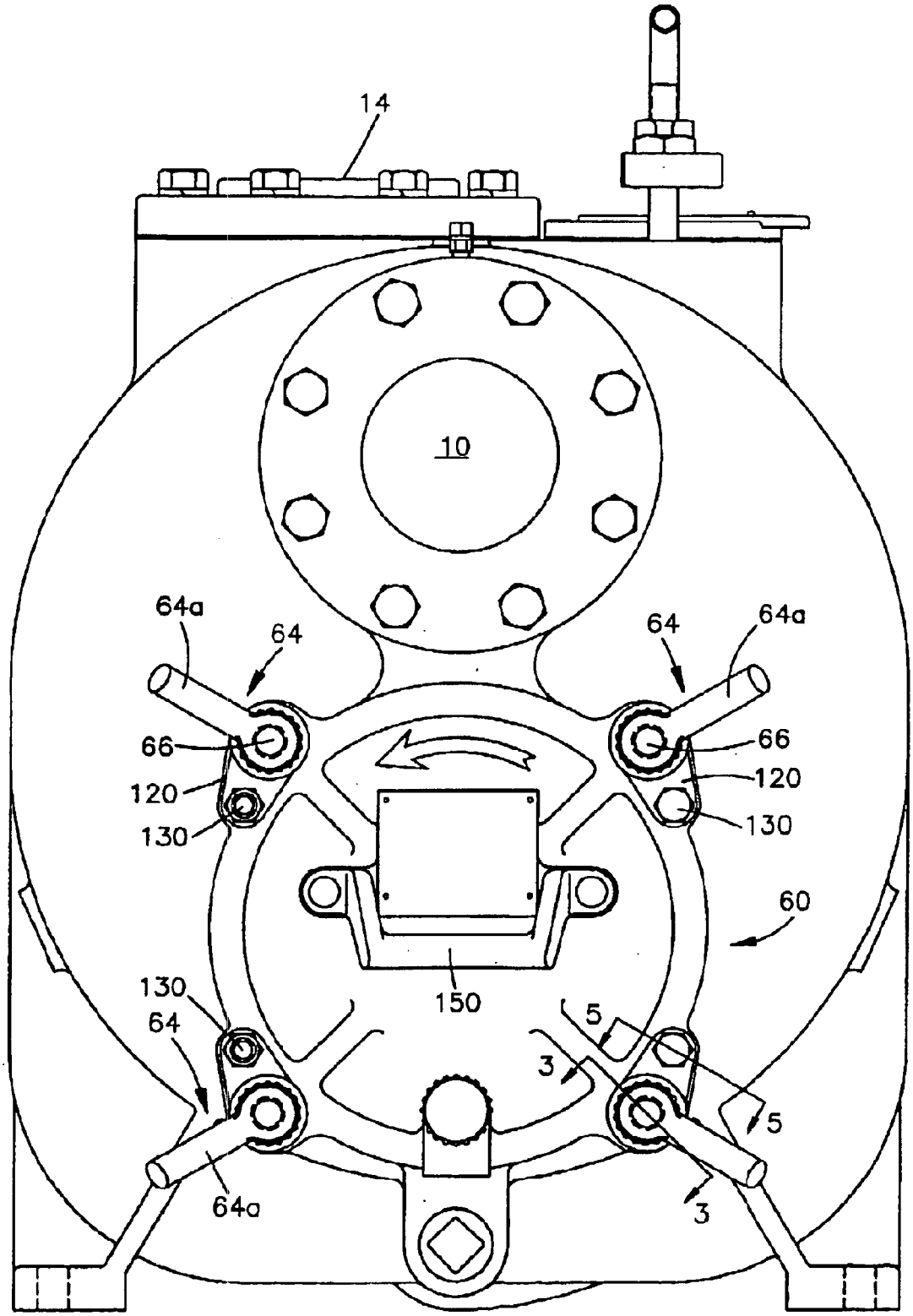
FIG. 1 is a front view of a self-priming pump constructed in accordance with the preferred embodiment of the invention.
Figure 2:
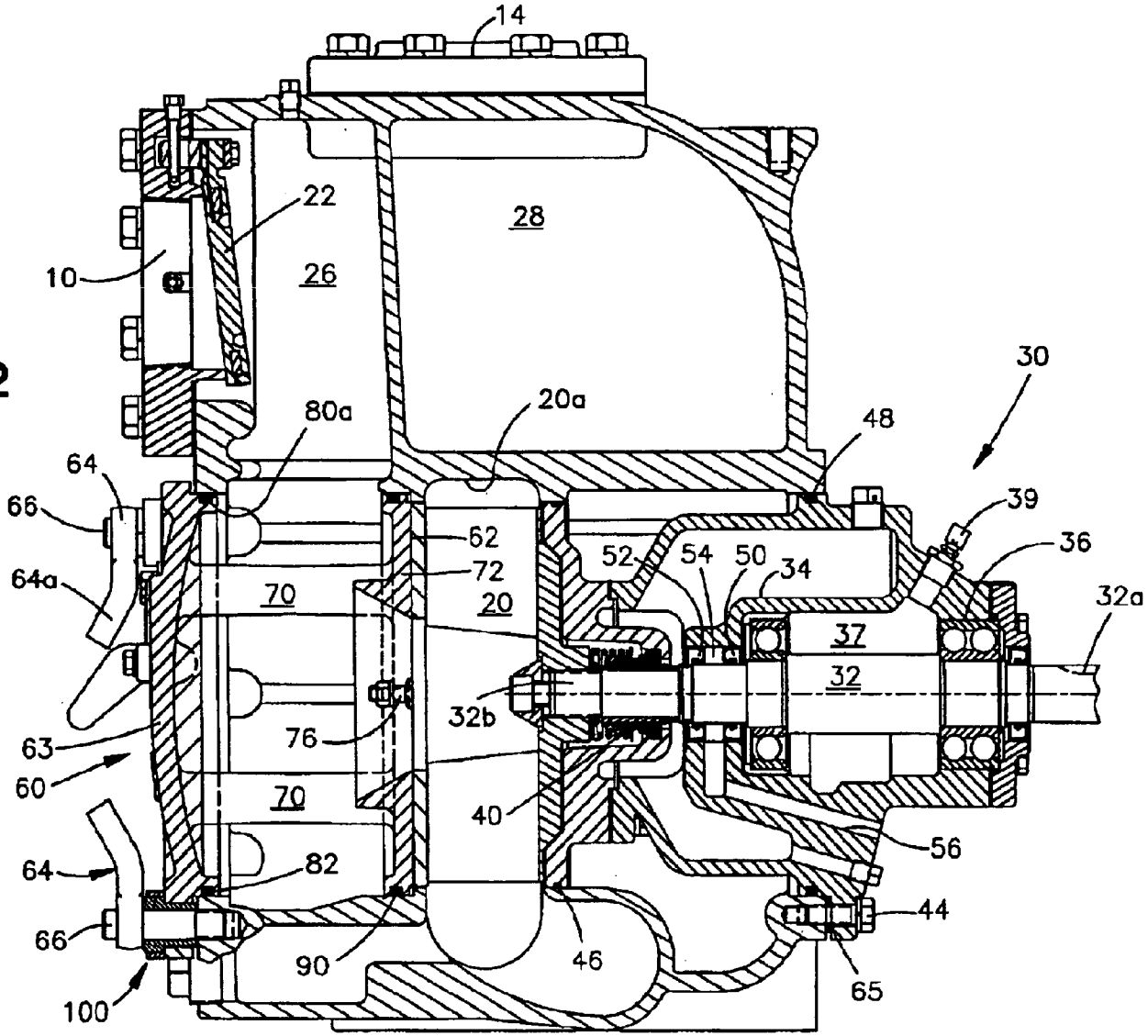
FIG. 2 is a sectional view of the pump shown in FIG. 1.

FIGS. 1 and 2 illustrate the overall construction of a centrifugal pump that incorporates the present invention. For purposes of explanation, the invention will be described in connection with a self-priming pump. The illustrated pump is of the type disclosed in U.S. Pat. No. 3,898,014 which is owned by the present assignee. A detailed explanation of the operation of a self-priming pump can be obtained by reference to U.S. Pat. No. 3,898,014 which is hereby incorporated by reference.

The present invention can also be adapted to other types of centrifugal pumps, such as the centrifugal pump disclosed in co-pending U.S. provisional application Ser. No. 60/178,174, filed Jan. 26, 2000, which is also hereby incorporated by reference.

Referring to both FIGS. 1 and 2, the disclosed self-priming pump includes an inlet or suction port 10 through which fluid to be pumped is drawn and an outlet or discharge port 14. As is conventional, a rotatable impeller 20 located in an impeller chamber 20*a* draws fluid through the suction port 10 and conveys it, under pressure, to the discharge port 14. As is also conventional, a check valve 22, located at the suction port 10, closes upon pump shut down and captures fluid within the pump. The check valve facilitates start-up of the pump after shutdown and reduces or eliminates the need for priming the pump. As more fully explained in U.S. Pat. No. 3,898,014, the disclosed pump has self-priming capability, even in circumstances when the check valve fails to fully close. Again, this self-priming capability is fully disclosed in U.S. Pat. No. 3,898,014.

The disclosed pump includes a conventional suction chamber 26 and a separation chamber 28. During initial start-up, the separation chamber 28 serves as a means for separating air from the fluid that is normally retained in the pump at shut down. The fluid is returned to the lower part of the volute or lower part of the pump housing to be reused as a priming fluid. The fluid is returned via passages and chambers (not shown) which are more fully explained in U.S. Pat. No. 3,898,014.

The impeller 20 forms part of a removable rotating assembly indicated generally by the reference character 30. The rotating assembly 30 includes a drive shaft 32 supported by a pair of spaced apart ball bearing assemblies 34, 36. The bearings 34, 36 are located in an isolated bearing chamber 37 which includes a fitting 39 through which bearing lubricant is added. An outboard end 32*a* of the drive shaft is connectable to a suitable drive source, such as an internal combustion engine or an electric drive motor. The impeller 20 is threaded onto an inboard end 32*b* of the drive shaft 32. A seal assembly 40 including non-rotating and rotating portions inhibits leakage of pumpage out of the impeller chamber 20*a*. An example of a face-type seal suitable for this application can be found in U.S. Pat. No. 4,815,747, dated Mar. 28, 1989, which is hereby incorporated by reference. The rotating assembly 30 is held in the pump housing by a plurality of bolts 44 (only one of which is shown). An O-ring seal 46 may be used to inhibit fluid leakage from the impeller chamber 20*a*. An O-ring seal 48 inhibits fluid leakage out of the pump housing.

A pair of spaced part seals 50, 52 sealingly engage the pump shaft 32 and are located to the left of the bearing chamber 37. The seal 50 inhibits fluid leakage out of the bearing chamber 37; the seal 52 inhibits fluid leakage along the shaft 32 from the other pump chambers. Should leakage occur, past either seal 50 or 52, into the region 54, the leakage fluid will be discharged through a vent passage 56 rather than traveling to other pump chambers as would be the case if a single seal were used. The presence of fluid in the vent passage 56 is also an indicator of impending or actual seal failure.

A removable clean-out assembly 60 is mounted in the pump housing opposite the rotating assembly. The clean-out assembly is removable in order to perform maintenance on the impeller 20 and to clear debris caught in the suction or impeller chambers 26, 20*a*, respectively.

According to the invention, the clean out assembly 60 serves as an adjustable support for a wear plate 62 which is positioned immediately adjacent the impeller 20. It should be understood by those skilled in the art that the clearance, termed "face clearance" between the wear plate 62 and the impeller affects the efficiency of the pump. Excessive clearance reduces pump efficiency. In the pump of the type illustrated in FIG. 1, the face clearance, i.e., the gap between the wear plate and the impeller is usually in the range of 0.010 inches to 0.020 inches. In prior art pump constructions, the rotating assembly would be typically shimmed in order to provide the necessary clearance. In the illustrated embodiment, a shim 65 is shown, which is used to set the initial position of the rotating assembly 30 and, which as will be explained below, serves as a means of obtaining additional adjustment of the face clearance.

According to the invention and as seen best in FIG. 2, the clean out assembly 60 includes a plurality of column-like standoffs 70 to which a wear plate support 72 is attached or integrally formed. The standoffs 70 extend from the inside of the end cover 63 and, in the preferred embodiment, are integrally formed with cover.

The wear plate 62 itself is secured to the wear plate support 72 by a plurality of fasteners 76 (only one of which is shown in FIG. 2). The end cover plate 63 sealingly engages an inside surface 80*a* of a clean out opening 80 defined by the pump housing by means of an O-Ring 82. The wear plate support 72 fits within an internal opening 88 defined by the pump housing. Fluid leakage through the opening is inhibited by an O-ring 90.

The clean out assembly 60 (including wear plate 62 and wear plate support 72) is removably held in the pump housing by four hand nuts 64 each including an arm 64*a*. As shown best in FIG. 1, the clean out assembly 60 includes an end cover or cap 63 which, after installation, is held to the pump housing by the four hand nuts 64. The hand nuts 64 threadedly engage threaded studs 66 which, as will be explained below, are attached to and extend from the pump housing. In effect, the hand nuts 64 clamp the end cover 63 to the pump housing.

According to the invention, the end cover 63 also mounts four retainer/adjustment assemblies indicated generally by the reference character 100 and which serve as a means for adjusting the position of the wear plate 62 with respect to the impeller 20.

In the illustrated embodiment, four adjustment assemblies 100 are shown as mounted to the end cover assembly 60. It should be understood, however, that this invention should not be limited to four adjustment assemblies. As an example, it is quite feasible to use three adjustment assemblies to provide the necessary adjustment function. Moreover, it may be desirable to use more than four adjustment assemblies in certain applications.

Figure 3:
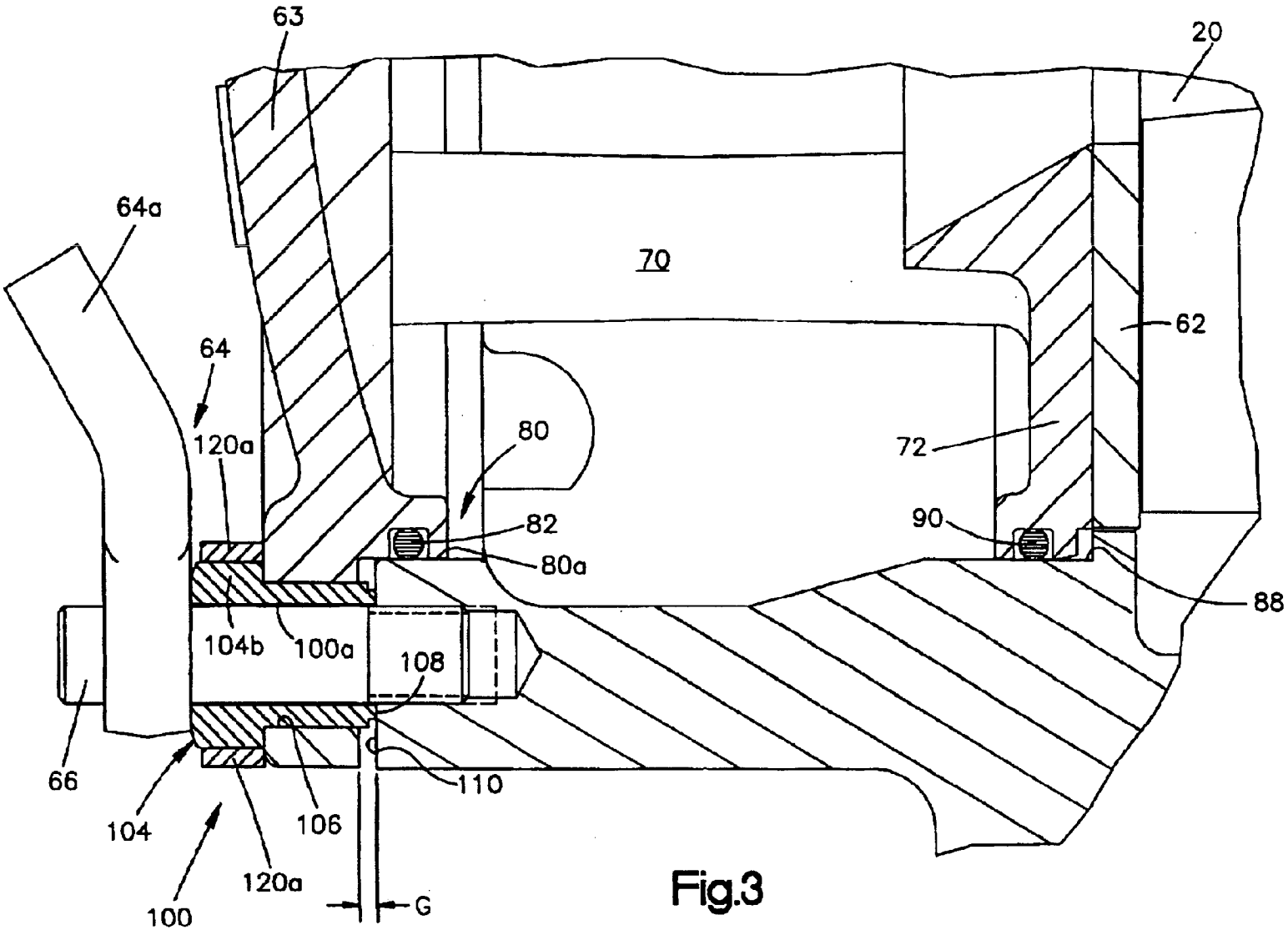
FIG. 3 is an enlarged, fragmentary, sectional view of the pump as seen from the plane indicated by the line A—A in FIG. 1 showing details of an adjustment assembly.
Figure 3A:
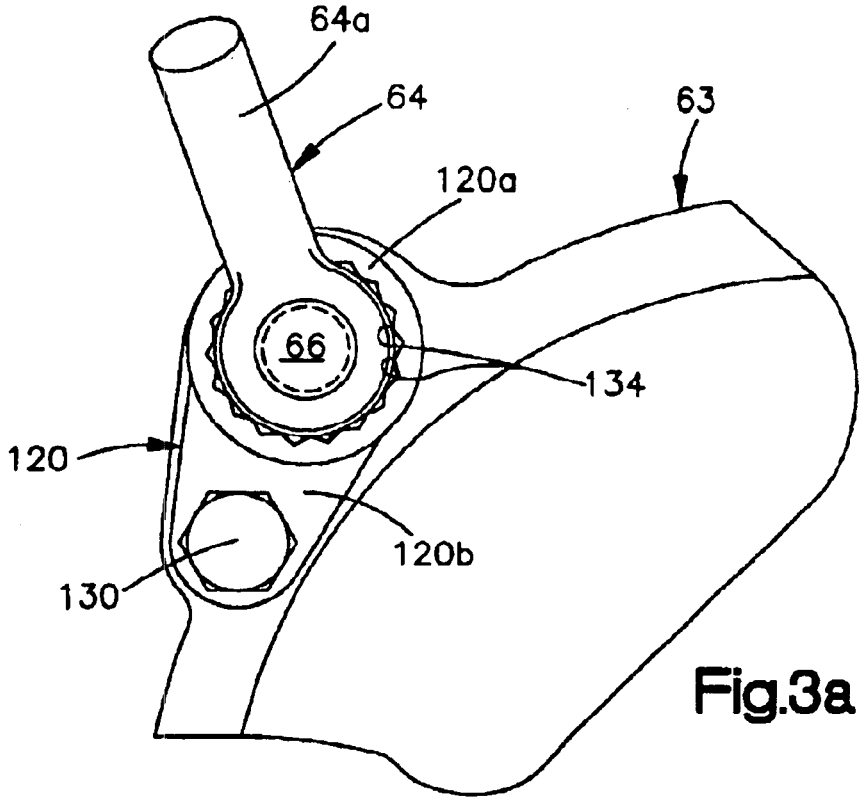
FIG. 3A is an enlarged, fragmentary, elevational view of the pump showing an adjustment assembly.
Figure 4:
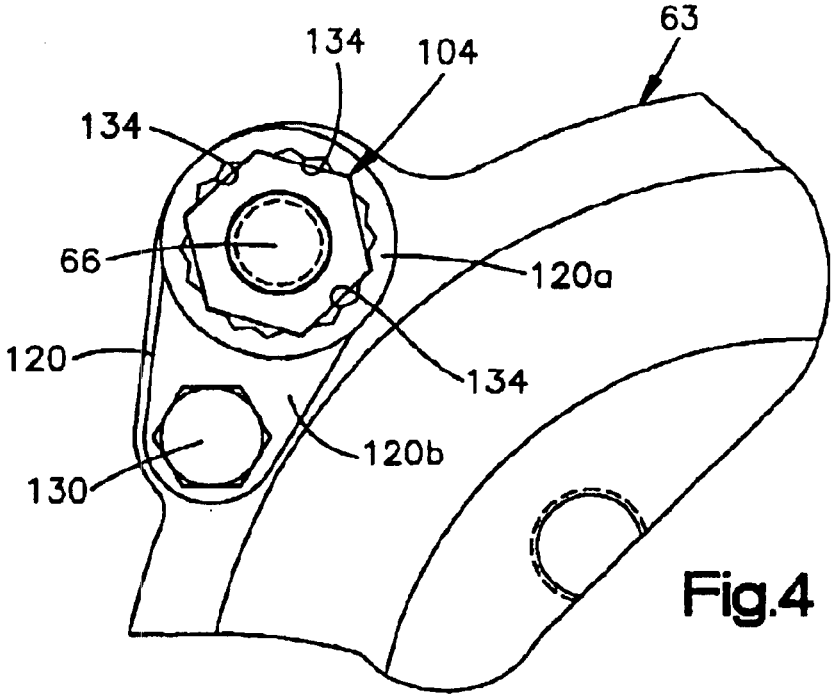
FIG. 4 is an enlarged, fragmentary view of the pump showing another view of the adjustment assembly with portions removed to show additional detail.

Referring also to FIGS. 3 and 4, each adjustment assembly 100 includes a bore 10*a* that slidably receives the associated threaded retainer stud 66. The four retainer studs 66 are threaded into the pump housing or volute. In prior art constructions, the threaded studs extend through bores in the end cover and, in turn, receive associated hand nuts 64 which serve to clamp the end cover to the pump housing.

In the construction of the present invention, each adjuster assembly includes a threaded adjustment member 104 that defines the throughbore 100*a*, which sized to slidably receive an associated retainer stud 66. The adjustment member 104 includes an externally threaded portion 104*a* which is threadedly received by an associated threaded bore 106 formed in the end cover. As seen best in FIG. 3, the adjustment member 104, when in its installed position, has an end surface 108 that abuts a volute surface 110 defined by the pump housing.

The position of the adjustment member 104 relative to the end cover 63 (which is determined by the extent to which it is threaded into the cover) determines a gap G between the end cover 63 and the pump housing. Since the wear plate 62 is rigidly attached to the end cover by means of the column-like stanchions 70 and wear plate support 72, the face clearance between the wear plate 62 and impeller 20 is determined by the position of the adjustment member 104 with respect to the end cover 63. For example, if the adjustment member 104 is rotated to move its end surface 108 towards the right, as viewed in FIG. 3, the gap G will increase which will in turn increase the face clearance between the impeller 20 and the wear plate 62. Conversely, if the adjustment member 104 is rotated in the opposite direction in order to move its end surface 108 towards the left, the gap G will decrease.

According to a further feature of this aspect of the invention and referring in particular to FIG. 4, a locking member 120 is used to fix the position of the adjustment member 104 once an adjustment has been made. The illustrated adjustment member 104 includes a hex-shaped head 104*b* for facilitating rotation by a wrench or other suitable tool. Other head shapes are also contemplated.

Figure 4A:
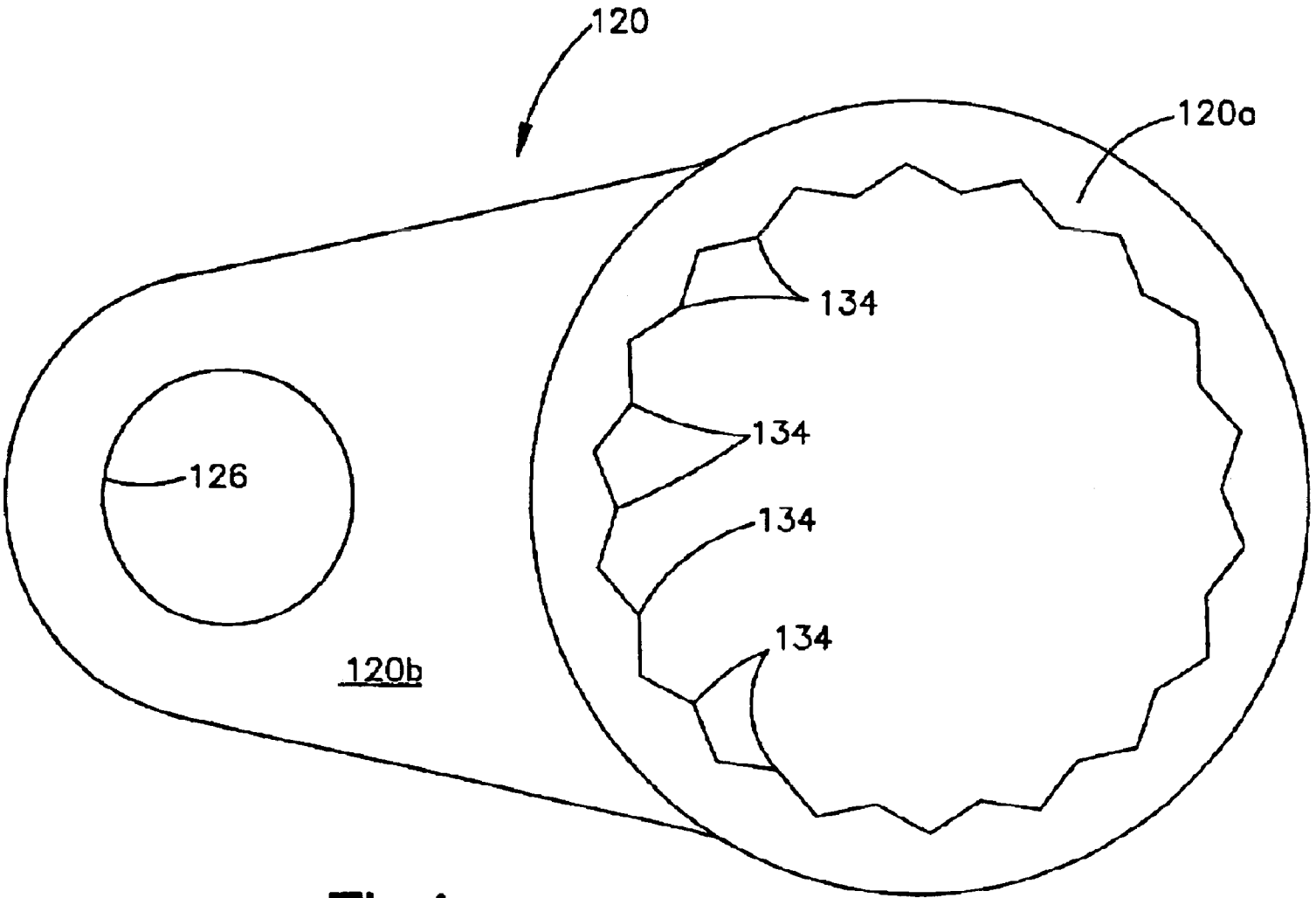
FIG. 4A is an elevational view of a locking member forming part of the present invention.

In the preferred embodiment, the adjuster head 104*a* is engageable by a locking member 120 which defines a collar portion 120*a* and a locking tab 120*b*. The collar portion 120*a* includes an opening having a plurality of symmetrically spaced, internal teeth-like protrusions 134. As seen best in FIG. 4, the opening is configured to receive the head 104*b* of the adjustment member 104. The teeth-like protrusions engage corners defined by the head portion 104*b* and inhibit relative rotation between the head portion 104*b* and the collar 120*a* of the locking member 120. The locking member 120 includes a hole 126 (see FIG. 4*a*) which is alignable with a threaded bore 128 formed in the end cover 63 (shown in FIG. 5). After an adjustment is made, the locking member is placed over the adjuster head 104*b* and in alignment with the threaded bore 128 formed in the end cover. Referring to FIG. 4, a fastener such as a bolt 130 is then installed to maintain the position of the locking member 120. Once the bolt 130 is installed, the locking member 120 inhibits rotation of the adjustment member 104.

In the illustrated embodiment, the collar portion 120*a* of the locking member 120 includes 18 protrusions or engagement teeth 134. By selecting a number of engagement teeth that is divisible by six, the locking collar 120*a* can engage the head 104*b* of the adjuster in any one of eighteen positions. (The hex-shaped head portion 104*b* defines six corners). The adjustment member 104 can be rotated by either the locking member 120 or by a suitable tool, such as a wrench, after the locking member 120 is removed. In the preferred method of adjustment, the locking member 120 is used to effect a precise adjustment of the face clearance. In particular, the locking collar 120*a* can be used as a gauge in order to rotate the adjustment member in precise 1/18 revolution increments. Since the amount of axial movement produced in the adjustment member is determined by the pitch of the thread on the threaded portion 104*a* of the adjustment member, a very precise face clearance can be established without the need for directly measuring the actual clearance between the impeller 20 and the wear plate 62.

As an example, if the threaded portion 104*a* of the adjustment member 104 is machined with a thread having 12 threads per inch, each full rotation of the adjustment member will produce 0.0833 inches of axial travel. With this geometry, each 1/18 of revolution produces 0.0046 inches of axial movement (0.0833 divided by 18).

The preferred method for adjusting the face clearance between the wear plate 62 and the impeller 20 is as follows. The clean-out assembly 60 is first installed into the pump housing by sliding it into position. During installation, the clamping studs 66 held by the pump housing slide through the bores 100*a* of the associated adjustment members (which are threaded into the end cover 63). During installation of the clean out assembly 60, the studs 66 act as guides and facilitate the sliding of the end cover assembly into the pump. The four adjuster members 104 are then unscrewed a sufficient amount to enable the end cover assembly 60 to move inwardly into the housing until contact is achieved between the wear plate 62 and the impeller 20. The adjuster members are then threaded inwardly until their end surfaces 108 abut the surface 110 formed on the pump housing or volute.

In the preferred method, the locking members are then placed over the adjusters, preferably with the locking holes 126 aligned with the threaded bores 128 in the cover 63. At this point, if a face clearance of approximately 0.010 inches is desired, the locking member 104 is removed and rotated counterclockwise (assuming that the threaded portion 104*a* of the adjustment member 104 is threaded with a right-hand thread) and repositioned on the head 104*b* of the adjustment member, such that it is rotated by two "teeth" from its aligned position. The collar portion 120*a* re-engages the head portion 104*b* and the locking member 120 is then rotated, clockwise, until the bore 126 is again aligned with the threaded bore 128 defined in the end cover 63. This movement produces 2/18 of a revolution in the adjustor, producing an axial travel of 0.0092 inches (0.0046 multiplied by 2) and, hence, moves the wear plate 62 away from the impeller by 0.0092 inches. The same procedure is performed with each adjuster and, upon completion, a face clearance of 0.0092 inches is established between the impeller 20 and the wear plate 62.

At the conclusion of each adjustment, the associated locking member 120 is secured to the end cover 63 by the associated locking bolt 130. It should be apparent that, if additional clearance is desired, the locking plate would be initially rotated with respect to the head portion 104*b* of the adjustment member 104*a* sufficient number of "teeth" in order to produce the desired axial movement.

With the present invention, once the adjustment is made and the locking members 120 secured, the clean out assembly 60 can be removed and reinstalled without affecting the face clearance. According to another feature of this aspect of the invention, the locking members 120 and/or adjustment members 104 can be used to initially break loose the end cover assembly 60 when it is to be removed. It has been found that if the end cover assembly is left in position over a significant amount of time, some difficulty may be encountered in breaking the cover free due to corrosion, etc. With the present invention, after the hand nuts 64 are removed, the adjusters 104 can be rotated (either directly or via the locking members 120) in a clockwise direction (again assuming a right-hand thread) to in effect "jack" the cover away from the pump housing. In most instances, once the cover is moved slightly by the adjustment members, it can be easily pulled from the pump using a handle 150.

Figure 5:
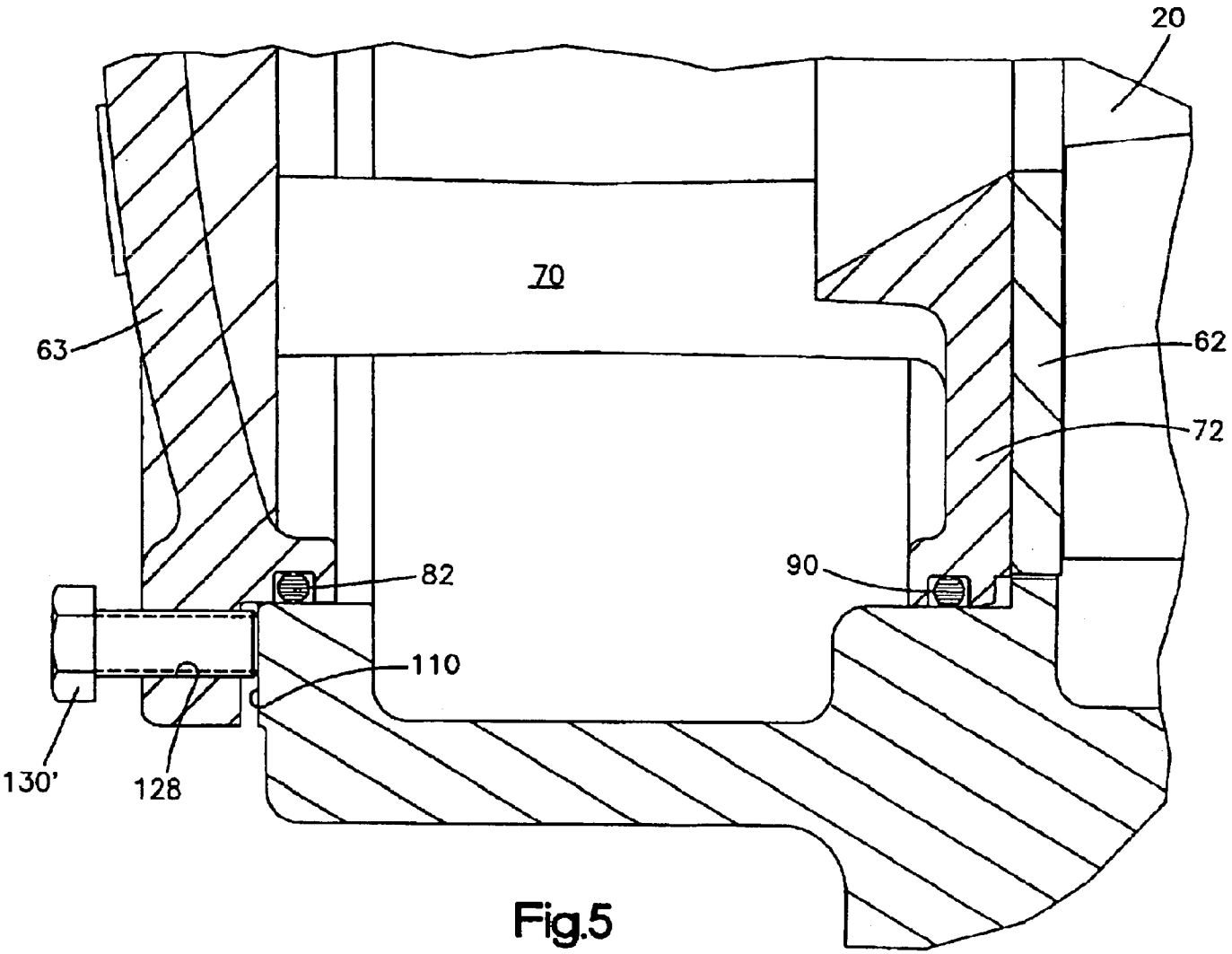
FIG. 5 is an enlarged, fragmentary view with parts removed as seen from the plane indicated by the line B—B in FIG. 1; and, FIG. 6 is an enlarged, fragmentary, elevational view of the pump showing an alternate embodiment of an adjustment assembly.

In accordance with this embodiment of the invention, the threaded bore 128, which under normal operation receives the locking bolt 130, can also be used to "jack" the end cover away from the pump housing. Referring to FIG. 5, the locking bolt 130 can be removed and replaced with a longer bolt 130' which has a length sufficient to contact the surface 110 of the volute or pump housing. For purposes of clarity, the jacking arrangement is shown in FIG. 5 with the locking member 120 removed. In actual use, however, the bolt 130' can be used to break loose the end cover 63 while the locking members 120 are left in position. By using this method of "jacking" the end cover, the position of the adjustment members 104 are not disturbed and, hence, the face clearance is unaffected upon reinstallation of the end cover assembly 60.

Figure 6:
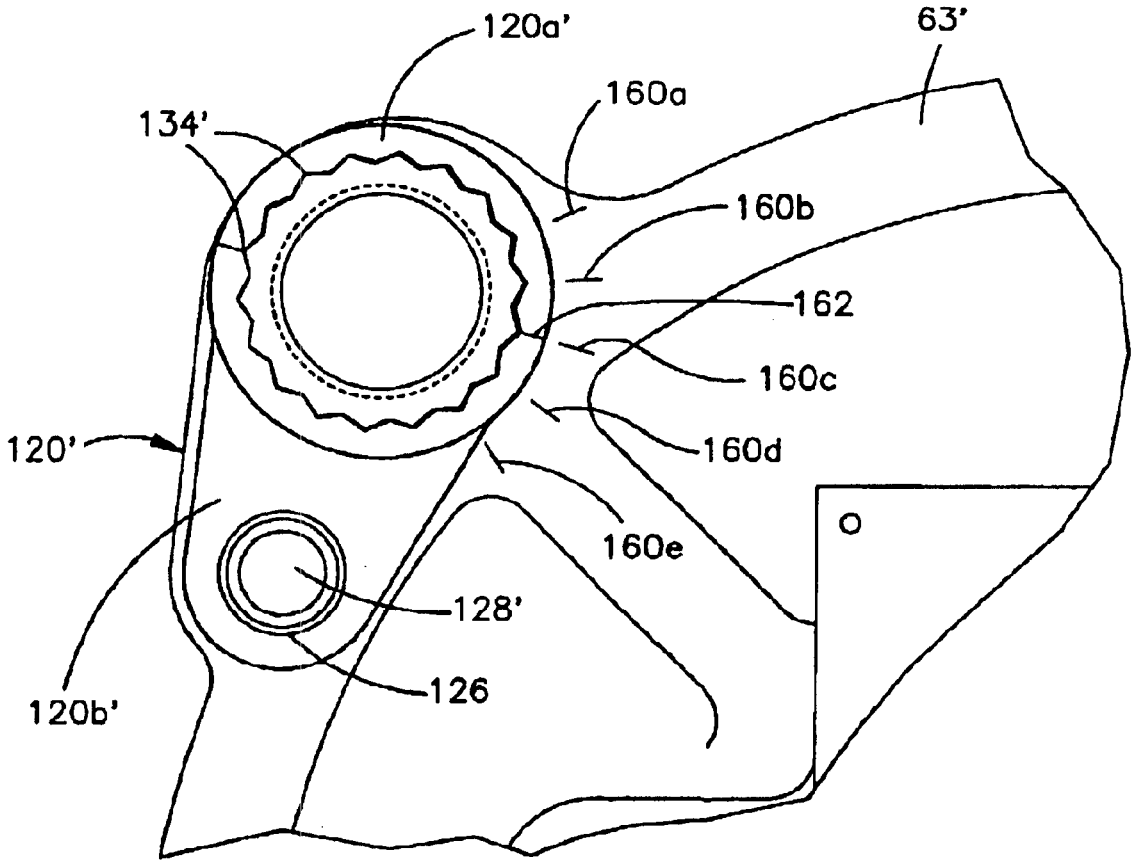

According to another embodiment of the invention, markings such as hash marks are provided on the locking member 120 and on the end cover 63 in order to provide a visual indication of the amount of axial movement of the adjustment member 104 during an adjustment procedure. As seen best in FIG. 6, five hash marks 160*a*, 160*b*, 160*c*, 160*d*, 160*e* are provided on the end cover 63 which correspond to the spacing of the teeth 134' in the collar 120*a*'. In the illustrated embodiment, there are eighteen teeth. The locking member includes a single hash mark 162 which, in FIG. 6, is aligned with the center hash mark 160*c* on the end cover 63. By removing the locking bolt, the locking member 120' can be rotated in order to rotate the adjustment member 104 and the extent of rotation can be precisely gauged by observing the movement of the mark 162 on the locking member 120 as it moves in relation to the markings on the end cover 63'. By rotating the locking member to move its hash mark 162 until it is aligned with an adjacent mark on the end cover, a 1/18 revolution of the adjuster is achieved. The 1/18 revolution will produce axial movement in the adjuster, the extent of which is determined by the pitch of the threads on the threaded portion of the adjuster 104.

As an example, if the threaded portion of the adjuster is machined with a thread having 12 threads per inch, each full rotation of an adjuster will produce 0.0833 inches of axial movement. The markings illustrated in FIG. 6 enable the adjuster to be rotated in 1/18 intervals, each interval producing 0.0046 inches of axial movement (0.0833 divided by 18).

The method for adjusting the face clearance between the wear plate 62 and the impeller 20 is as follows in the second embodiment. After the clean out assembly is installed and the adjustment members positioned so that contact between the wear plate 62 and impeller 20 is established, the locking members 120' are placed over the adjusters, preferably with their locking holes 126' aligned with the threaded bores 128' in the cover 63. At this point, the line 162 on the locking plate should be aligned with the central line mark 160*c* formed on the end cover 63*c* and shown in FIG. 6. As indicated above, it is generally desirable to have a face clearance of about 0.010 inches to 0.020 inches. By rotating a locking member 120' clockwise (again assuming a right hand thread) until the mark 162 is aligned with the mark 160*e* would cause the end cover 63 to move outwardly, i.e., towards the left, as viewed in FIG. 2, producing a clearance of 0.0092 inches (0.0046 multiplied by 2), which is approximately 0.010 inches. The locking member 120' is then lifted off the head of the adjustment member and repositioned so that the hole 126' and bore 128' are aligned. If additional clearance is desired, the procedure is repeated until the desired clearance is obtained. The locking bolt 130 is then installed which prevents further movement in the adjustment member.

In the preferred embodiment, the adjustment members 104 are shown as being threadedly received by the end cover 63. However, it should be understood that the adjustment mechanism can be adapted for use with the rotating assembly 30. In particular, adjustment components, such as those forming part of the overall adjuster 100, can replace the bolts 44 and shims 65 so that the position of the rotating assembly 30 can be precisely positioned with respect to a wear plate forming part of a fixed, non-adjustable, clean out assembly to provide the required clearance.

According to another feature of the invention, the rotating assembly 30, as indicated above, is mounted with a shim 65 located between the pump housing and a flange surface forming part of the rotating assembly. In prior art constructions, shims similar to the shims 65 were used to adjust the face clearance. In the present invention, the shims can be used to provide an added range of movement to accommodate wear in the wear plate 62. For example, the wear plate 62 could wear to the point that the adjusters cannot perform sufficient adjustment to decrease the face clearance to an acceptable amount. In other words, if excessive wear occurs, the adjustment capability of the adjusters could be exceeded. If this should occur, the shims 65 can be removed which, upon removal, will enable the rotating assembly to move inwardly towards the wear plate a distance equal to the removed shims. The decrease in face clearance provided by the shim removal would enable the adjustment members forming part of the end cover 63 to be used to establish the proper face clearance between the wear plate 62 and the impeller 20. This feature reduces the frequency with which the wear plate 62 has to be replaced.

Although the invention has been described with a certain degree of particularity, it should be understood that those skilled in the art can make various changes to it without departing from the spirit or scope of the invention as hereinafter claimed.

We claim:

1. A centrifugal pump, comprising:

a) a pump housing;

b) a rotating assembly including a pump impeller mounted to said housing, said pump impeller defining an axis of rotation;

c) a removable clean-out assembly mounted to said pump and supporting a wear plate in axial alignment with said impeller and including an end cover;

d) a plurality of adjustment members carried by said end cover for adjusting a face clearance between said wear plate and said impeller, at least one of said adjustment members, including:

i) an adjuster threadedly received by said end cover and defining a bore for receiving a stud extending from said pump housing;

ii) said adjuster defining an abutment surface for abuttably contacting a surface on said pump housing whereby the position of said adjuster in said end cover determines the spacing between said impeller and said wear plate;

iii) a locking member for locking said adjuster with respect to said end cover to inhibit rotation.

2. The centrifugal pump of claim 1, wherein said pump includes four adjustment members carried by said end cover.

3. The centrifugal pump of claim 2, wherein said adjuster includes a polygonal-shaped head engageable by a collar portion forming part of said locking member.

4. The apparatus of claim 3, wherein said locking member includes head engagement structure which allows said collar portion to engage said head in any one of a plurality of positions.

5. The apparatus of claim 4, wherein said structure defines 18 teeth and said head portion is hex-shaped.

6. The apparatus of claim 5, wherein said adjuster includes a threaded portion, said threaded portion is being machined with a thread pitch of 12 threads per inch, such that a 1/18 revolution of said adjustment produces approximately 0.0046 of axial movement.

7. The centrifugal pump of claim 2, wherein said studs are threaded and said end cover is held to said pump housing by hand nuts that threadedly engage said threaded studs extending through the bores of said adjusters.

8. The centrifugal pump of claim 1 further including a pair of spaced apart shaft seals and a vent passage for discharging fluid that leaks into a region between the spaced apart seals.

9. A centrifugal pump comprising:

a) a pump housing;

b) a removable rotating assembly including an impeller and a drive shaft defining an axis for said impeller, said drive shaft connectable with a drive source;

c) a removable clean-out assembly supporting a wear plate in axial alignment with said impeller;

d) a face clearance adjustment mechanism associated with one of said assemblies;

e) said face clearance adjustment mechanism comprising at least one adjuster threadedly received by one of said assemblies and engageable with structure on said pump housing, such that rotation of said adjuster produces axial movement in its associated assembly towards and away from the other assembly;

f) said adjuster rotatable to produce a predetermined clearance between said impeller and said wear plate;

g) a locking member for inhibiting rotation in said adjuster in order to fix said face clearance established by said adjuster.

10. The centrifugal pump of claim 9, wherein said adjuster forms part of said clean-out assembly.

11. A centrifugal pump comprising:

a) a pump housing;

b) a rotating assembly including an impeller and a drive shaft defining an axis of rotation for said impeller, said drive shaft connectable to a drive source;

c) a removable clean-out assembly supporting a wear plate in axial alignment with said impeller;

d) a face clearance adjustment mechanism associated with one of said assemblies;

e) said face clearance adjustment mechanism comprising at least one adjuster threadedly received by one of said assemblies and engageable with structure on said pump housing, such that rotation of said adjuster produces axial movement in its associated assembly towards and away from the other assembly;

f) said adjuster rotatable to produce a predetermined clearance between said impeller and said wear plate;

g) a locking member for inhibiting rotation in said adjuster in order to fix said face clearance established by said adjuster.

12. The centrifugal pump of claim 11 wherein said at least one adjuster is threadedly received by said removable clean out assembly.

13. The centrifugal pump of claim 12 wherein said at least one adjuster is adapted to receive a stud extending from said pump housing.

14. The apparatus of claim 13 wherein said stud is threaded whereby said clean out assembly is held to said pump housing by threaded members.

15. The centrifugal pump of claim 14 wherein said threaded members are hand nuts.

16. The centrifugal pump of claim 11 wherein said face clearance adjustment mechanism comprises a plurality of adjusters threadedly received by one of said assemblies.

17. A centrifugal pump comprising:

a) a pump housing including at least one fluid chamber;

b) a pump impeller connected to a drive shaft for rotation therewith;

c) at least one bearing for rotatably supporting said drive shaft, said bearing located within a bearing chamber;

d) a seal assembly associated with said impeller including non-rotating and rotating portions, at least one of said portions being in fluid communication with said one fluid chamber;

e) first and second, spaced apart seals sealingly engaging said shaft and located intermediate said seal assembly and said bearing chamber; and, f) said first seal associated with said bearing chamber;

g) said second seal inhibiting fluid leakage along said shaft from said one fluid chamber; and, h) a discharge passage communicating with a region between said seals whereby any fluid that leaks past said first or second seals is discharged through said discharge passage.

18. The centrifugal pump of claim 17 wherein said discharge passage extends in a general downward direction with respect to said pump shaft.

19. The centrifugal pump of claim 17 further including:

a) a removable clean out assembly mounted to said pump and supporting a wear plate in axial alignment with said impeller, said removable clean out assembly including an end cover;

b) a plurality of adjusters carried by said end cover for adjusting a face clearance between said wear plate and said impeller, at least one of said adjusters, including:

i) an adjustment member threadedly received by said end cover and defining a bore for receiving a stud extending from said pump housing;

ii) said adjustment member defining an abutment surface for abuttably contacting a surface on said pump housing whereby the position of said adjustment member in said end cover determines the spacing between said impeller and said wear plate; and, iii) a locking member for locking said adjuster with respect to said end cover to inhibit rotation.

20. The centrifugal pump of claim 17 wherein said pump shaft and bearing housing form part of a rotating assembly and said centrifugal pump further includes:

a) a removable clean out assembly supporting a wear plate in axial alignment with said impeller;

b) a face clearance adjustment mechanism associated with one of said assemblies;

c) said face clearance adjustment mechanism comprising at least one adjuster threadedly received by one of said assemblies and engageable with structure on said pump housing, such that rotation of said adjuster produces axial movement in its associated assembly towards and away from the other assembly;

d) said adjuster rotatable to produce a predetermined face clearance between said impeller and said wear plate; and, e) a locking member for inhibiting rotation in said adjuster in order to fix said face clearance established by said adjuster.

21. A centrifugal pump comprising:

a) a pump housing;

b) an impeller attached to a drive shaft defining an axis of rotation for said impeller, said drive shaft connectable to a drive source;

c) at least one bearing located within a bearing chamber for rotatably supporting said drive shaft;

d) a seal assembly for inhibiting leakage of pumpage out of an impeller chamber;

e) first and second spaced apart seals sealingly engaging said drive shaft and located intermediate said seal assembly and said bearing chamber;

f) structure defining a region between said seals, said region communicating with a vent passage; and, g) said first seal inhibiting fluid leakage between said region and said bearing chamber, said second seal inhibiting leakage between another chamber in said pump and said region, said vent passage operative to discharge any fluid that leaks past said first and second seals.

22. The centrifugal pump of claim 21 wherein said other chamber comprises said impeller chamber.

23. The centrifugal pump of claim 22 wherein said vent passage is located below said drive shaft.

24. A centrifugal pump comprising:

a) a pump housing including at least one fluid chamber;

b) a pump impeller connected to a drive shaft and rotatable within an impeller chamber;

c) at least one bearing for rotatably supporting said drive shaft, said bearing located within a bearing chamber;

d) a seal assembly associated with said impeller for inhibiting fluid leakage between said impeller chamber and said one fluid chamber;

e) first and second, spaced apart seals sealingly engaging said shaft and located intermediate said seal assembly and said bearing chamber;

f) said first seal associated with said bearing chamber;

g) said second seal inhibiting fluid leakage along said shaft from said one fluid chamber; and, h) a discharge passage communicating with a region between said seals whereby any fluid that leaks past said first or second seals is discharged through said discharge passage.

* * * * *